US007748370B1

(12) United States Patent
Choma

(10) Patent No.: US 7,748,370 B1
(45) Date of Patent: Jul. 6, 2010

(54) METHOD OF COCKING A CROSSBOW HAVING INCREASED PERFORMANCE

(75) Inventor: David A. Choma, Tallmadge, OH (US)

(73) Assignee: Horton Archery, LLC, Kent, OH (US)

( * ) Notice: Subject to any disclaimer, the term of this patent is extended or adjusted under 35 U.S.C. 154(b) by 314 days.

(21) Appl. No.: 11/903,696

(22) Filed: Sep. 25, 2007

(51) Int. Cl.
*F41B 5/12* (2006.01)

(52) U.S. Cl. ..... 124/25

(58) Field of Classification Search ..... 124/25
See application file for complete search history.

(56) References Cited

U.S. PATENT DOCUMENTS 3,538,901 A * 11/1970 Switack ..... 124/25
4,603,676 A * 8/1986 Luoma ..... 124/25
5,243,956 A * 9/1993 Luehring ..... 124/86
5,749,348 A * 5/1998 Oviedo-Reyes ..... 124/25
6,874,491 B2 * 4/2005 Bednar ..... 124/25
6,901,921 B1 * 6/2005 Barnett ..... 124/25
2006/0086346 A1 * 4/2006 Middleton ..... 124/25

OTHER PUBLICATIONS

Bushmaster Firearms International, LLC, Windham, ME Catalog—cover and p. 3.

* cited by examiner

*Primary Examiner*—John Ricci
(74) *Attorney, Agent, or Firm*—Renner, Kenner, Greive, Bobak, Taylor & Weber

(57) ABSTRACT

A crossbow (20) has a stock (21) which can be adjusted in length by utilization of an adjustment mechanism (34). In order to conveniently cock the crossbow (20) the adjustment mechanism (34) is used to shorten the length of the stock (21). But when the crossbow (20) is to be fired, the length of the stock may be increased as described by the user.

5 Claims, 4 Drawing Sheets

METHOD OF COCKING A CROSSBOW HAVING INCREASED PERFORMANCE

TECHNICAL FIELD

This invention relates to a method which makes it easier to cock a crossbow. Mores specifically, this invention relates to such a method which permits maintaining the performance of the crossbow.

BACKGROUND ART

The performance of a crossbow can generally be measured by the speed of the arrow that is being propelled by the crossbow. This speed is dictated primarily by the length of the stroke that the arrow is pushed by the bowstring. Thus, the longer the barrel of the stock of a crossbow, the longer the stroke and faster the arrow resulting in a high performance crossbow.

The facile cocking of a crossbow has always been a problem and the longer stock of high performance crossbows compounds that problem. That is, the longer the stock, the harder it is to cock the crossbow. FIG. 1, to be hereinafter described in more detail, depicts one of the problems associated with cocking a crossbow having a longer stock. Typically, when a crossbow is being cocked, the user places his foot in the stirrup and places the butt end of the crossbow against his torso, usually his chest. Then he bends over and attempts to reach the bowstring so that he can pull it back to be engaged by the trigger. Oftentimes, even the most agile person has trouble reaching the string, as shown in FIG. 1, because of the long stock. But if by chance he is able to grasp it, he is so stooped over that it is difficult to generate the sometimes extreme force necessary to cock a crossbow. Thus, the user who wants a crossbow that is easier to cock does so to the detriment of performance.

DISCLOSURE OF THE INVENTION

It is thus a object of the present invention to provide a method of increasing the performance of a crossbow without rendering it more difficult to cock.

It is another object of the present invention to provide a method of cocking a high performance crossbow.

These and other objects of the present invention, as well as the advantages thereof over existing prior art forms, which will become apparent from the description to follow, are accomplished by the improvements hereinafter described and claimed.

In general, in accordance with the present invention, a method of increasing the performance of a crossbow without rendering the crossbow more difficult to cock includes the steps of providing a crossbow having a stock of a desired performance length, and reducing the length of the stock prior to cocking the crossbow.

In accordance with another aspect of the invention, a method of cocking a crossbow having a bowstring near one end of a stock includes the steps of reducing the length of the stock, grasping the bowstring, and pulling the bowstring to a cocked position along the length of the stock.

A preferred exemplary crossbow used to perform a method of the present invention is shown by way of example in the accompanying drawings without attempting to show all the various forms and modifications in which the invention might be embodied, the invention being measured by the appended claims and not by the details of the specification.

PREFERRED EMBODIMENT FOR CARRYING OUT THE INVENTION

Figure 1:
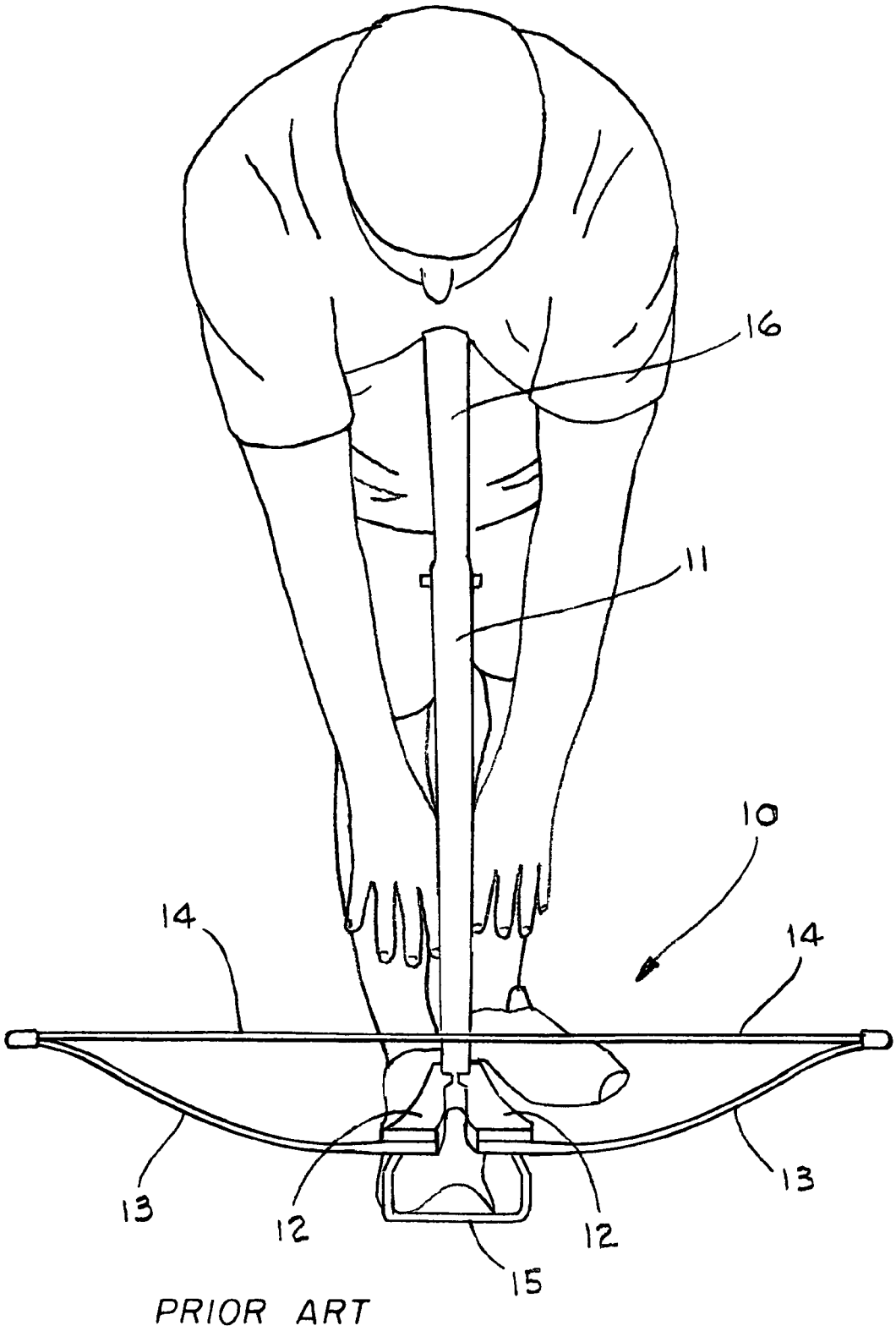
PRIOR ART FIG. 1
FIG. 1 is a somewhat schematic representation of a person attempting to cock a high performance crossbow of the prior art.

FIG. 1 depicts a person attempting to cock a conventional high performance crossbow, generally indicated by the numeral 10, of the prior art. Crossbow 10 is shown as having a stock 11 which is of a length conductive to high performance as previously described. A riser 12 is attached to one end of the stock 11, and the riser 12 carries one end of opposed flexible limbs 13. The other end of limbs 13 carries a bowstring 14 usually through a system of pulleys or cams (not shown). Riser 12 also carries a cocking stirrup 15.

In order to manually cock crossbow 10, the user puts his foot in stirrup 15, as shown in FIG. 1, and the butt end 16 of the stock 11 is positioned against the user's torso. The user then attempts to reach down to grasp the bowstring 14, but as shown in FIG. 1, the length of the high performance stock 11 is often such that the user cannot readily reach the bowstring 14.

A crossbow which is designed to allow the user to cock the same without detriment to the performance thereof is generally indicated by the numeral 20 and shown in FIGS. 2-5. Crossbow 20 has many of the same basic features of the conventional crossbow shown in FIG. 1 and thus includes a stock generally indicated by the numeral 21, which carries one end of opposed flexible limbs 23, with the other end of each limb 23 carrying a bowstring 24 usually through a system of pulleys or cams (not shown). Riser 22 also carries a cocking stirrup 25.

Figure 3:
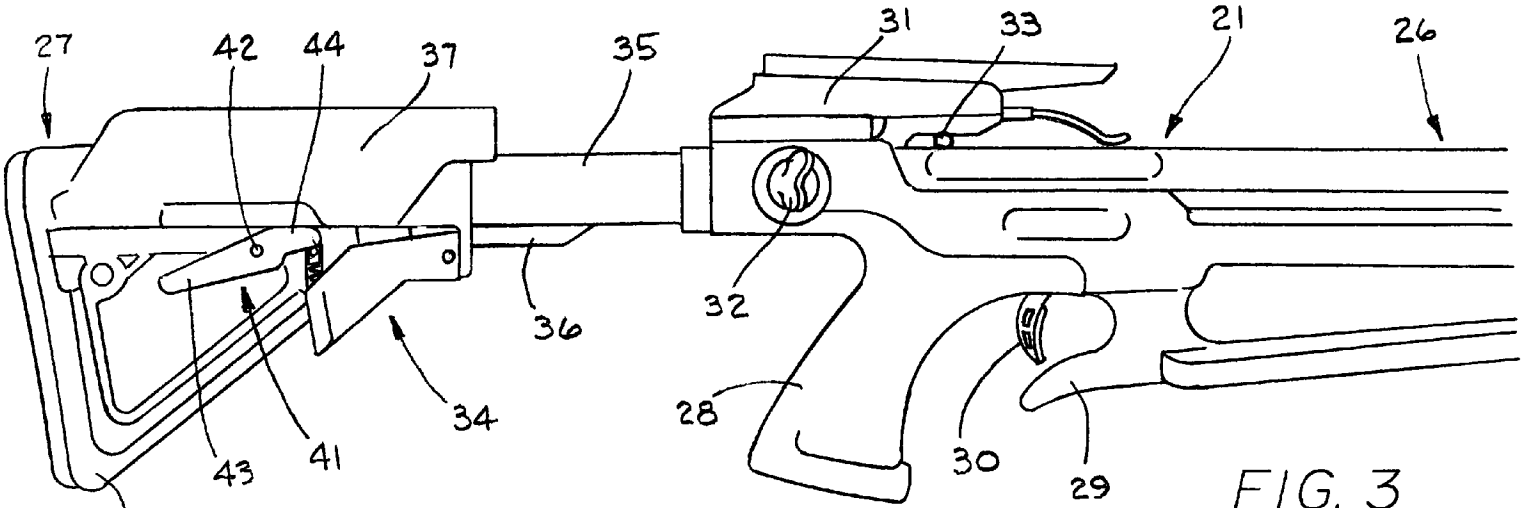
FIG. 3 is a somewhat schematic, fragmented elevational view of a high performance crossbow having the stock thereof in an extended position for use to discharge the crossbow.
Figure 4:
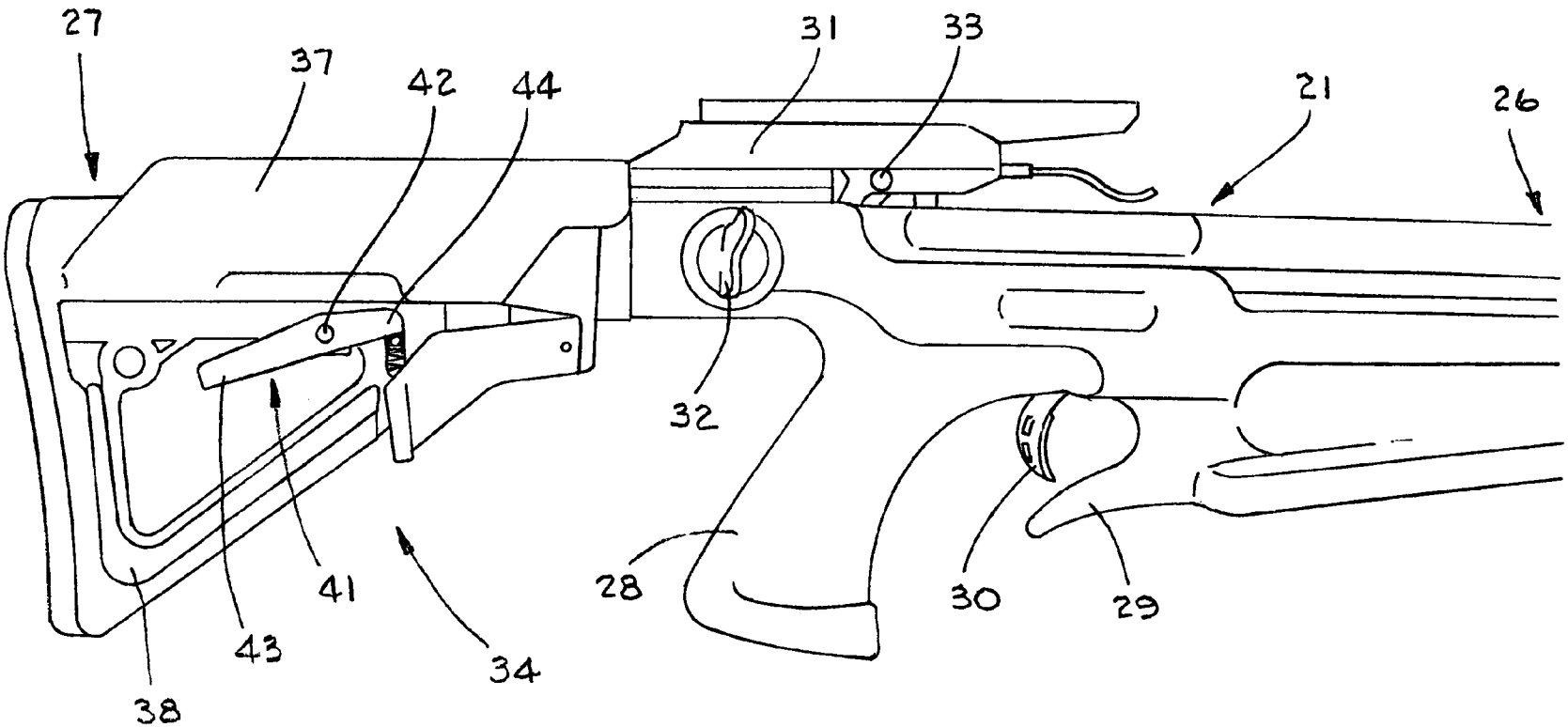
FIG. 4 is a view similar to FIG. 3 but showing the stock thereof in a retracted position for use when cocking the crossbow.

More of the details of stock 21 are shown in FIGS. 3 and 4. Stock 21 thus includes a barrel end 26, only partially shown in FIGS. 3 and 4, and a butt end generally indicated by the numeral 27. Between ends 26 and 27, stock 21 is formed to provide a pistol grip 28 and a trigger guard 29 to protect a trigger 30 from accidentally firing. A sight 31 may also be carried by stock 21 and can be adjusted by a dial 32. A trigger safety 33 extends outwardly from stock 21, and in the cocking process, the bowstring 24 is pulled back until it engages the trigger 30 which at the same time can activate the safety 33 so that the crossbow 20 cannot be fired until the safety 33 is manually displaced.

Figure 5:
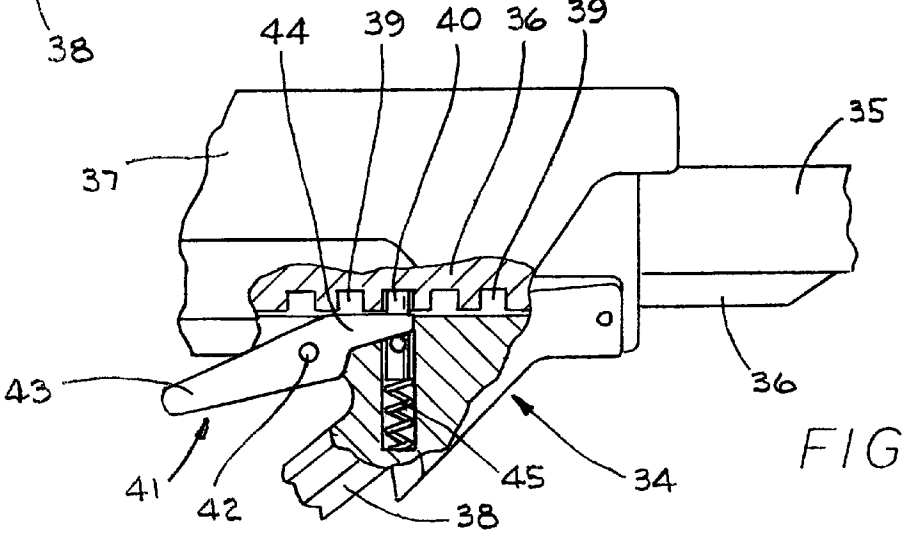
FIG. 5 is a fragmented, broken-away view of a portion of the stock having a length adjusting mechanism.

The butt end 27 of the stock 21 is provided with an adjustment mechanism, generally indicated by the numeral 34, which adjusts the length of stock 21. The specific type of mechanism 34 is not important to the present invention, but the mechanism 34 shown includes a tube 35 extending rearwardly from behind the grip 29 of stock 21. Tube 35 has a lug 36 formed along the bottom thereof and is received in an aperture in the body 37 of a handle member 38. The aperture thus takes on the same cross-sectional profile as the tube 35 and the lug 36, and thus handle member 38 cannot rotate on tube 35. As shown in FIG. 5, lug 36 is provided with a plurality of spaced apertures 39 which selectively receive a pin 40 carried within body 37 of handle member 38. A release mechanism, generally indicated by the numeral 41, is pivotable on an axis 42 and includes an actuating arm 43 which is on one side of axis 42 and which extends out of body 37, and a second arm 44 which is on the other side of pivot axis 42 and which extends into body 37. Arm 44 controls pin 40 which is biased by a spring 45. Pin 40 is adapted to be received in one of the apertures 39 of lug 36 of tube 35 and is maintained in the selected aperture 39 by spring 45. Then when the user wishes to adjust the length of stock 21, he merely squeezes on arm 43 to rotate mechanism 41 on axis 42 which causes arm 44 to compress spring 45 and move pin 40 out of the aperture 39 that it was in so that tube 35 can be moved in body 37 to the desired new position. At that time, release of arm 43 allows pin 40 to move into the aperture 39 at the desired length of stock 21.

Figure 2:
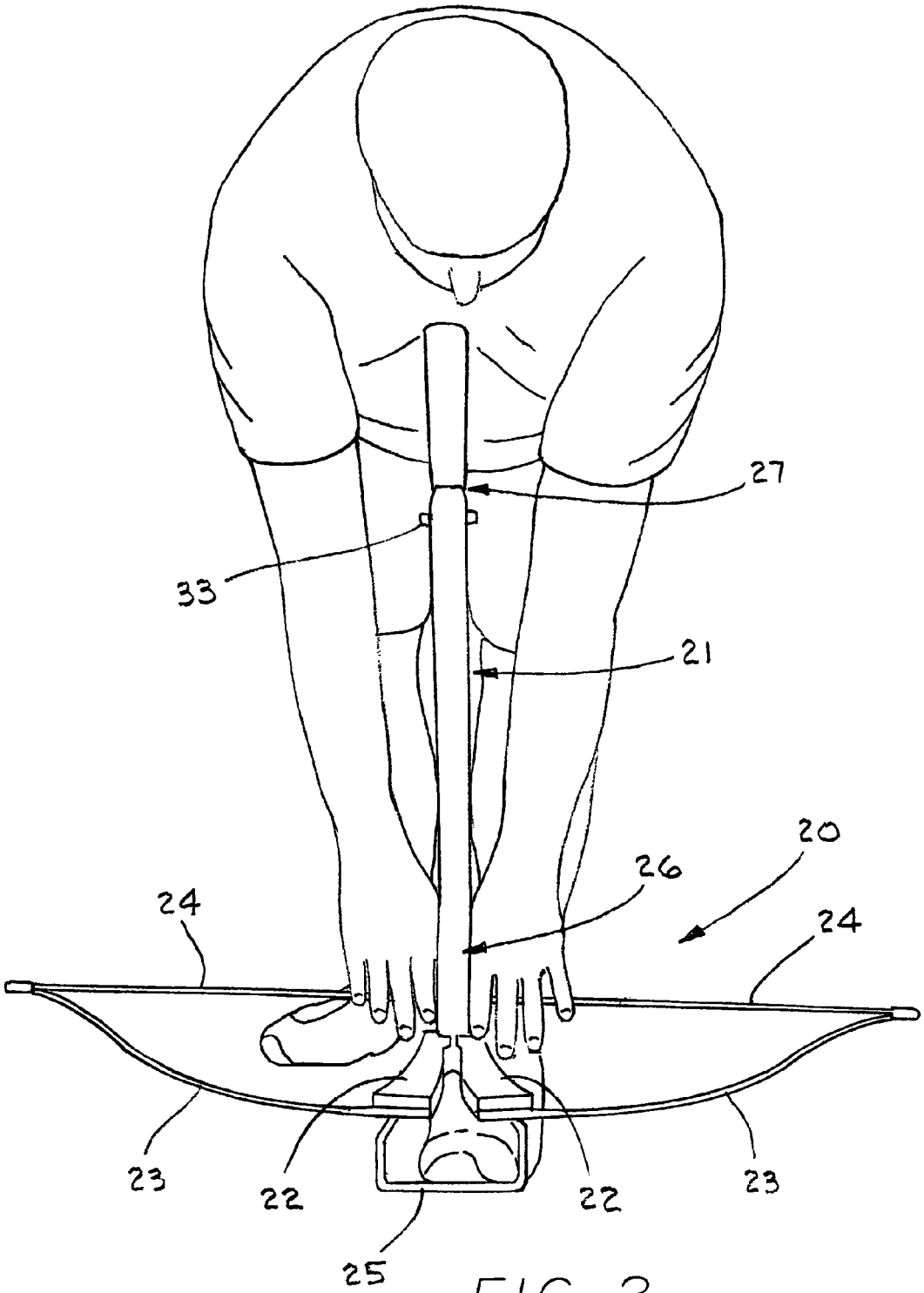
FIG. 2 is similar to FIG. 1 but showing the cocking of the high performance crossbow utilizing the method of the present invention.

As a result of utilizing the adjustment mechanism 34 as just described, or any equivalent conventional adjusting mechanism, the length of the stock 21 can be adjusted from its maximum length, as shown in FIG. 3, to its minimum length, as shown in FIG. 4, or it can be at any position therebetween, as defined by apertures 39. In the FIG. 4 position, the crossbow 20 can easily be cocked, as shown in FIG. 2, but when it is to be fired, the length of the stock can be adjusted for the comfort of the user up to its maximum length shown in FIG. 3.

In view of the foregoing, it should be evident that a crossbow constructed as described herein accomplishes the objects of the invention and otherwise improves the art.

What is claimed is:

1. A method of cocking a crossbow having a bowstring near one end of a stock comprising the steps of reducing the length of the stock to a reduced length, grasping the bowstring, and pulling the bowstring along the stock to a cocked position while maintaining the reduced length.

2. The method of claim 1 wherein the crossbow has a stirrup formed at the one end and further comprising the step of placing a foot on the stirrup prior to grasping the bowstring.

3. The method of claim 1 further comprising the step of placing the other end of the stock against the chest of the person cocking the crossbow.

4. The method of claim 3 further comprising the step of bending over to reach the bowstring in order to perform the step of grasping the bowstring.

5. A method of increasing the performance of a crossbow having a stock without rendering the crossbow more difficult to cock comprising the steps of providing a crossbow having a stock of a desired performance length, reducing the length of the stock prior to cocking the crossbow, cocking the crossbow, and then increasing the length of the stock.

* * * * *